US010807778B2

(12) United States Patent
Pape

(10) Patent No.: US 10,807,778 B2
(45) Date of Patent: Oct. 20, 2020

(54) BAG WEB AND METHOD FOR PACKING A PRODUCT IN FILM BAGS BY USING SUCH A BAG WEB

(71) Applicant: Schur Technology A/S, Horsens (DK)

(72) Inventor: Henrik Pape, Horsens (DK)

(73) Assignee: Schur Technology A/S, Horsens (DK)

( * ) Notice: Subject to any disclaimer, the term of this patent is extended or adjusted under 35 U.S.C. 154(b) by 329 days.

(21) Appl. No.: 15/309,892

(22) PCT Filed: Jun. 30, 2015

(86) PCT No.: PCT/DK2015/050193
§ 371 (c)(1),
(2) Date: Nov. 9, 2016

(87) PCT Pub. No.: WO2016/000718
PCT Pub. Date: Jan. 7, 2016

(65) Prior Publication Data

US 2017/0137192 A1 May 18, 2017

(30) Foreign Application Priority Data

Jun. 30, 2014 (DK) ..... 2014 70406

(51) Int. Cl.
*B65D 75/42* (2006.01)
*B65B 9/08* (2012.01)
(Continued)

(52) U.S. Cl.
CPC ..... *B65D 75/42* (2013.01); *B65B 1/04* (2013.01); *B65B 7/02* (2013.01); *B65B 9/08* (2013.01);
(Continued)

(58) Field of Classification Search
CPC ..... B65D 75/42; B65D 75/48; B65D 75/008; B65B 43/123; B65B 43/267; B65B 43/54;
(Continued)

(56) References Cited

U.S. PATENT DOCUMENTS 3,599,388 A * 8/1971 Feingold ..... B65B 9/087 53/455
4,774,797 A 10/1988 Colamussi
(Continued)

FOREIGN PATENT DOCUMENTS

CN 1298357 A 6/2001
CN 1507401 A 6/2004
(Continued)

*Primary Examiner* — Thanh K Truong
*Assistant Examiner* — Katie L Gerth
(74) *Attorney, Agent, or Firm* — James Creighton Wray

(57) ABSTRACT

There is disclosed a bag web for packing articles in film bags provided as a contiguous web. At an opening edge, the bag web is provided with peripheral strip areas having holes intended for guide connection with guide means that can retain and guide the bags along a conveyor path through a filling station. The bag items will thus be contiguous along an upper edge, which is used for guiding. The bag webs include the film webs forming opposing front and back sides of the bag and additional film pieces disposed between the flat sides of the bag in order thereby to form side or bottom, or both side and bottom, of the bag. By such a bag web is achieved a particularly simple and rapid filling of the type with stand bottom and with folded side edges.

7 Claims, 18 Drawing Sheets

(51) Int. Cl.

| | |
|---|---|
| ***B65B 43/12*** | (2006.01) |
| ***B65B 43/26*** | (2006.01) |
| ***B65B 1/04*** | (2006.01) |
| ***B65B 7/02*** | (2006.01) |
| ***B65B 43/52*** | (2006.01) |
| ***B65B 43/54*** | (2006.01) |
| ***B65B 51/30*** | (2006.01) |
| ***B65B 61/12*** | (2006.01) |
| ***B65B 61/18*** | (2006.01) |
| ***B65D 33/25*** | (2006.01) |
| ***B65D 75/00*** | (2006.01) |
| ***B65D 75/48*** | (2006.01) |
| ***B65D 75/58*** | (2006.01) |

(52) U.S. Cl.
CPC ..... *B65B 43/123* (2013.01); *B65B 43/267* (2013.01); *B65B 43/52* (2013.01); *B65B 43/54* (2013.01); *B65B 51/30* (2013.01); *B65B 61/12* (2013.01); *B65B 61/18* (2013.01); *B65D 33/25* (2013.01); *B65D 75/008* (2013.01); *B65D 75/48* (2013.01); *B65D 75/5805* (2013.01)

(58) Field of Classification Search
CPC .. B65B 1/04; B65B 7/02; B65B 43/52; B65B 75/5805; B65B 51/30; B65B 61/12; B65B 61/18; B65B 33/25; B65B 9/08; B31B 70/16; B31B 70/18; B31B 70/266
USPC ..... 53/459; 493/223, 224, 243
See application file for complete search history.

(56) References Cited

U.S. PATENT DOCUMENTS 4,863,285 A * 9/1989 Claxton ..... B65D 31/00 383/37
4,969,310 A * 11/1990 Lerner ..... B65B 9/08 53/384.1
5,210,993 A * 5/1993 van Boxtel ..... B65B 43/123 493/198
6,182,395 B1 * 2/2001 Weder ..... B65B 25/02 47/72
6,591,586 B1 * 7/2003 Pape ..... B65B 43/123 53/381.2
6,796,932 B2 9/2004 Kuge
6,990,787 B2 * 1/2006 Rasmussen ..... B65B 43/465 53/381.2
2002/0147090 A1 * 10/2002 Kuge ..... B65D 31/10 493/162
2003/0165278 A1 * 9/2003 Baker ..... B65B 43/123 383/37
2005/0244084 A1 * 11/2005 Tilman ..... B65D 33/2591 383/64
2012/0076441 A1 * 3/2012 Kruse ..... B65D 75/008 383/12
2014/0033654 A1 * 2/2014 Stanley ..... B65B 1/02 53/452

FOREIGN PATENT DOCUMENTS

| | | | |
|---|---|---|---|
| EP | 0396838 | A1 | 11/1990 |
| EP | 0780309 | A1 | 6/1997 |
| EP | 0825116 | A1 | 2/1998 |
| EP | 1250999 | A1 | 10/2002 |
| JP | 20010058057 | | 9/2002 |
| JP | 4688949 | B2 | 4/2011 |
| JP | 5580244 | B2 | 11/2012 |
| JP | 6322430 | B2 | 7/2015 |
| WO | 9207764 | A1 | 5/1992 |
| WO | 9425365 | A1 | 11/1994 |
| WO | 9957017 | A1 | 11/1999 |
| WO | 02070349 | A1 | 9/2002 |
| WO | 03031268 | A1 | 4/2003 |

* cited by examiner

BAG WEB AND METHOD FOR PACKING A PRODUCT IN FILM BAGS BY USING SUCH A BAG WEB

This application claims the benefit of Danish Application No. PA 2014 70406 filed Jun. 30, 2014, and PCT/DK2015/050193 filed Jun. 30, 2015, International Publication No. WO 2016/000718, which are hereby incorporated by reference in their entirety as if fully set forth herein.

FIELD OF THE INVENTION

The present invention concerns a bag web for packing articles, liquid or loose material in film bags that are provided in a contiguous web of bag items, wherein the bag web along its opening edges includes peripheral strip areas prepared with a series of holes or corresponding star perforations intended for guide connection with guide means, which are arranged for retaining and guiding peripheral areas at the opposing bag opening edges along a conveyor path through a filling station, the bag web being of the type consisting of a contiguous series of bag items separated by a number of slits that extend from a bottom edge of the web up to a point below an upper edge of the web.

The invention further concerns a method for packing a product, preferably articles or loose material, in film bags by using such a bag web, the method including steps wherein:

two film webs that are to form front and back sides of the bags are provided along their opening edges with peripheral strip areas, in which a series of holes or corresponding star perforations are formed.

BACKGROUND OF THE INVENTION

A basic example of this technology is mentioned in EP-696 997 in which it is stated that the opposite upper edge areas of the bag item web is made with bent peripheral parts formed by channels for drawing in on conveyance bars which have a mutual expansion for producing an opening of the bag items in the direction of conveyance, such that these can be filled, for example through a superjacent funnel, whereafter the conveyance bars are narrowed against each other again for temporary closing of the filled bag items. These may then be closed finally by welding below the said channel parts, after which these are cut off and the items are mutually separated. As alternative is specified that instead of the channel parts there may be used edge thickenings that may be received in slotted guide tubes for corresponding conveying of the bag items.

Since then, other types of means have been suggested for catching and carrying the opposite upper edges of the bag item web, for example as stated in EP 0 555 321 B where special catching chains are used for the purpose without special requirements to the design of the upper edge areas of the folded bag item web. This is of substantial significance in that as a basic material a simple rolled op flat film web without local thicknesses may be used, however in return there are considerable problems with regard to both the guidance of the opposite edges of the bag items for a safe engagement with the chains and with regard to a desirably inexpensive embodiment of these chains.

In EP 0 396 838 and EP 0 825 116 it is furthermore stated that a flat tubular web of the film can be applied which can be cut open continuously along its upper edge with integrated unfolding and catching of the thus cut open upper edges, without the latter being specifically designed neither as grooves nor with thickenings, providing a distinct simplification of the requirements for the formation of the bag web. The cut up upper edge parts are unfolded for squeezing between respective moving belts, which are formed with longitudinal recesses and corresponding cords for pressing in, whereby a suitably firm carrying engagement can be established.

This engagement, however, is not more firm than axial slipping may occur between the upper edges of the bag web and associated belt conveyor means, whereby uncertainty may arise as to whether a conveyed item has been conveyed entirely synchronously with the conveyor belts. Furthermore, deviations with regard to level of the area of the web sides squeezed between the conveyor belts may arise, which can have significance to whether the filled bags are finally closed right on the spot intended for this purpose, e.g. with regard to print on the bag.

In EP 1 087 890 is described a technique which uses a simplified flat bag web of the kind mentioned in the introduction, as said opening edge is merely closed when the web is introduced on a single carrier bar and is continuously cut open in a station, whereby the thereby upright peripheral strip parts are unfolded in order to be laid down on opposite chains. These strip parts are made in advance with a row of holes which are moved down upon upwardly pointed holding studs on the carrier chains during folding down whereby a safe carrier and propelling engagement is achieved without any special profiling of the opening edges. The contents of this document is hereby incorporated by reference.

EP 1 451 069 discloses a similar technique that also uses a simplified flat bag web of the kind mentioned in the introduction. Here, edge strip parts will also be made in advance with a row of holes which are moved down on upwardly directed holding studs on the carrier chains during folding down such that a secure carrier and propelling engagement is achieved without any special profiling of the opening edges. The contents of this document is hereby incorporated by reference.

The prior art bag webs of the kind mentioned in the introduction are thus only used for making and filling of flat bags.

Bags of the type with side and bottom pieces connected with the flat sides are known as well. They will usually be folded sides and/or bottom. This bag type is also known as gusset bags or bags with cross bottom, or also known as side-gusseted bags where short sides are formed between the flat sides of the bag. Side pieces and bottom pieces, which are welded to the large flat sides of the bag, are therefore provided in these bags. Such bags can be formed in webs with a series of juxtaposed bag items. This web is cut up for forming individual bags. The bags may be provided with a zipper. The bags are filled subsequently by moving the individual bags to a filling station at which filling is performed. An example of such a web and making thereof are described in EP 1 250 999, the contents of which are hereby incorporated by reference.

For many years there has been a wish for increasing the rate of filling and for producing the bags with side folds and/or bottom folds cheaper.

It is primarily a wish to be able to combine bags with folded sides and/or bottom in connection with the technology of the two mentioned European patents where the use of studs provide a secure carrier and propelling engagement. However, there is a similar wish in connection with the other described prior art techniques.

OBJECT OF THE INVENTION

It is the object of the invention to indicate a bag web and a method for packing a product in film bags by using such a bag web, where the bag web occurs as a continuous web which is conveyed through a filling station, and thereby provides a high filling rate.

A further object of the invention is to indicate a bag web of bag items enabling a high filling rate and cheap production of the bags.

DESCRIPTION OF THE INVENTION

This object is achieved according to the present invention by a bag web of the kind mentioned in the introduction, which is peculiar in that the bag web includes film webs that form opposing front and back sides of a bag, and additional film pieces that are disposed between the front and back sides for formation of side or bottom, or both side and bottom, of the bag.

The front and back sides of the bag are also to be named as the flat sides of the bag.

The method according to the invention is peculiar in that

- the two film webs are superposed, and additional film pieces are placed between the film webs for forming side or bottom, or both side and bottom, of the bags;
- the film webs and the additional film pieces are welded together for forming a contiguous web of bag items;
- by conveying on a support rail, the bag web is brought to engage guide means that ensure retention of the bag web along a conveyor path through a filling station;
- along its opening edges, the continuous bag web is brought in guide connection with guide means adapted to interact with the series of holes or corresponding star perforations, thereby retaining and guiding the peripheral areas at the opposite bag opening edges along a conveyor path through the filling station;
- in connection with passage through the filling station, the guide means force the opposing bag mouth edges apart for successive opening of the bags;
- the continuous web of bag items is conveyed through a filling station in which the bag openings are kept open for receiving filling material;
- the bag opening edges are joined again after filling the bags for closing the bags;
- the bags are closed after passing through the filling station and separated from the web.

It is noted that the continuous bag web will usually be placed in a storage, either in the form of a roll or a box in which the continuous bag web is placed. From this storage the bag web will typically be conveyed to a filling machine. However, alternatively it also possible to convey the formed film webs directly to a filling machine.

By such a design of the bag web, the advantages of filling the flat bags from a bag web according to EP 1 087 890 and EP 1 451 069 are combined with the advantages of standing bags or other bags of the type known from EP 1 250 999, and which are provided with inserted, preferably folded, sides and/or bottom. By such bags bottom is achieved a high filling rate as the bags are moved contiguously to a filling station where they are opened and filled, and only after filling are separated from the bag web.

It is particularly advantageous to combine bags with inserted sides and/or bottom in a bag web according to the said EP patents, where the use of studs and peripheral strip areas in which a series of holes or corresponding star perforations are formed provide a secure carrying and propelling engagement.

According to an embodiment, the bag web may be peculiar in that the additional film pieces are folded for the formation of folded sides or bottom, or both folded sides and bottom. Such bags in which the bottom is folded can be used as standing bags, and by folded sides is achieved bags with larger filling capacity than bags only made with flat sides.

According to a further embodiment, the bag web may be peculiar in that the bag web includes two superposed film webs that are welded together with additional film pieces forming sides or bottom, or both sides and bottom. By bags where there are both sides and bottom between the two superposed film webs it is possible to make bags which along their height have a largely rectangular cross-section, which is a bag type preferred for a wide range of products. The additional film pieces, or some of these, may constitute part of the films used for making the flat sides of the bag.

According to a further embodiment, the bag web may be peculiar in that the additional film pieces forming sides or bottom or both sides and bottom are separate film pieces that are welded together with the two bag webs. Separate film pieces will be used by this design such that the flat sides of the bag are formed by two superposed film webs having the same width.

According to a further embodiment, the bag web may be peculiar in that the bag web includes two superposed film webs, and that a first film web is wider than a second film web as the first film web has a peripheral area that is folded for formation of a bottom of the bag, and which is welded together with the first film web. In such a bag web, one flat side of the bag and the bottom of the bag will be formed of the first film web, and the second flat side of the bag will be formed of the second film web. The need for coordinated insertion of separate film pieces for the formation of the bag bottom is hereby reduced.

According to a further embodiment, the bag web may be peculiar in that a zipper is provided on the film web forming the front or back side of the bag, the zipper including interacting zipper parts, and that in connection with the zipper and in parallel therewith a weakening line or perforation is provided which is easily torn up for establishing an access opening to the interior of a finished bag, the access opening capable of being opened and closed by means of the zipper. A zipper may in this bag be placed in a technically simple way, and an access opening to the contents of the bag will be formed in one of the flat sides of the bag. The advantage of this bag is that it is easy to make such that it is entirely airtight.

According to a further embodiment, the bag web may be peculiar in that interacting zipper parts of a zipper are provided opposite each other on the film webs forming opposing front and back sides of the film web of the bag, and that these interacting zipper parts are provided in parallel with the opening edges in immediate vicinity thereof for establishing an access opening to the interior of a finished bag, the access opening capable of being opened and closed by means of the zipper. By this disposition of the zipper, the access opening will be formed at the top of the bag between the peripheral area of the two flat sides. This provides a large access opening.

According to a further embodiment, the bag web may be peculiar in that the additional film pieces forming the sides extend from the bottom of the bag to a position adjacent to the zipper parts. A zipper that extends over the entire width of the bag can hereby be used, and the side sections of the bag then do not extend along the entire height of the bag. In order to ensure tightness at the transition between the zipper and the side edges, the zipper located at the side edge will usually be flattened in a press.

According to a further embodiment, the bag web may be peculiar in that longitudinal weldings forming a stand bottom edge in a finished bag are formed in a peripheral area at the bottom side edges of the film web, the bottom side edges provided at the opposite side of the film webs in relation to the opening edges. In a simple way is hereby achieved a strong and solid stand bottom in the bag.

According to a further embodiment, the method may be peculiar in that a zipper is provided on the film web forming the front or back side of the bag, the zipper including interacting zipper parts, and that in connection with the zipper and in parallel therewith a weakening line or perforation is formed that is easily torn up for establishing an access opening to the interior of a finished bag, the access opening capable of being opened and closed by means of the zipper. This will be a simple way of establishing a reclosable access opening to the bag.

According to a further embodiment, the method may be peculiar in that interacting zipper parts of a zipper are placed opposite each other on the film webs forming opposing front and back sides of the bag film web, and that these interacting zipper parts are disposed in parallel with the opening edges in immediate vicinity thereof for establishing an access opening to the interior of a finished bag, the access opening capable of being opened and closed by means of the zipper. A large reclosable access opening at the top of the bag will be established hereby.

According to a further embodiment, the method may be peculiar in that longitudinal weldings forming a stand bottom edge in a finished bag are formed in the peripheral areas at the bottom side edges of the film webs, the bottom side edges provided at the opposite side of the film webs in relation to the opening edges. In a simple way is hereby achieved a strong and solid stand bottom in the bag.

Also, only bag web with a series of bag items is mentioned, but within the scope of the invention it will also be possible to apply two or more juxtaposed bag items in a bag web.

According to a further embodiment, the method may thus be peculiar in that the bag web is provided with a central support region extending longitudinally of the bag web, the central support region connecting bag items that are disposed side by side transversely of the web, that the central support region is conveyed on the support rail along the conveyor path through the filling station, and that it is the peripheral areas at the outermost opposite bag opening edges of two juxtaposed bag items that are brought in guiding connection with the guide means.

According to a further embodiment, the bag web may thus be peculiar in that it is provided with a central support region extending longitudinally of the bag web, the central support region connecting bag items that are disposed side by side transversely of the web, that the central support region is conveyed on the support rail along the conveyor path through the filling station, and that it is the peripheral areas at the outermost opposite bag opening edges of two juxtaposed bag items that are brought in guiding connection with the guide means.

In a surprisingly simple way it appears to be possible to increase the filling rate significantly and at the same time reduce the price of producing and filling the bags, only by providing a bag web having bag items disposed side by side transversely of the web. The bag web thus appears with two juxtaposed rows of contiguous bag items. These two rows are connected with the central support region extending longitudinally of the bag web.

This central support region is supported on the support rail which is known from the technique in the two European patents EP 1 087 890 and EP 1 451 069. It is only necessary to extend such a support rail so as to extend along the conveyor path through the filling station for supporting the two juxtaposed bag webs in the filling station. Bag items from each of the two rows will be supported by the common central guide rail at their common central support region, and supported by the guide means at each of the peripheral areas at the outermost opposite bag opening edges of two juxtaposed bag items.

The guide means can thus be designed according to the above described prior art techniques as well as the peripheral areas of the bag items can be designed according to the prior art techniques. There is only need for modifying the filling station in a way so that it e.g. has two filling units that fill the two juxtaposed bag items simultaneously.

When performing the invention, the constructional details of bag web and method known from the two European patents EP 1 087 890 and EP 1 451 069, the contents of which are hereby incorporated by reference, can be applied.

When performing the invention, the constructional details of making the bag items of the bag web known from the European patens EP 1 250 999, the contents of which is hereby incorporated by reference, can be applied as well.

According to a further embodiment, the method may thus be peculiar in that the bag web is provided from one common mother film, and that a separation is performed for establishing two film webs that are to form front and back sides of the bags.

According to a further embodiment, the method may thus be peculiar in that the film web is used optionally for making one or two bag webs.

According to a further embodiment of making a bag web used for packing products, a sequence of steps to be specified below are applied. Firstly, unrolling of film material from a film roll is performed which subsequently is to form front and back sides and bottom of the bags. The film can be used for making one or two bag webs.

After unrolling, the film web is moved through a buffer zone where a tension is established in the web, and where edge guidance and vertical folding and dividing of the film are performed such that an upper and a lower web to form the front and back sides of the bags are formed. By this step, the web material used for forming the bottom of the bags is provided as part of the upper web. The lower web will subsequently be used for placing loose side folds.

Then the film is passed through a converter that changes the conveying from continuous to intermittent conveyance.

After that, film web will be supplied from a separate reel and buffer storage for forming side folds. The film web used is unwound and then moved transversely of the lower film web.

After unwinding the film, a folding occurs such that a tube is formed. During this procedure, an edge guidance of the film web used for formation of the side fold is established.

Thereafter, spot welding of the tubular side fold film is performed before it is inserted transversely of the lower web. Shortening of the side fold film to the desired length is performed.

The side fold film is then transferred in a two-step film transfer unit to the lower web. In the first sequence, the side fold film is transferred transversely of the film webs. This typically occurs between two toothed belts. Then the side fold film is transferred to the lower web in the conveying direction for the lower web.

Following that, the side fold film is spot welded to the lower web.

The side fold film is subsequently divided by a dividing cutter. By the dividing cutter, the welded side fold film will be subjected to a longitudinal folding of two bottom folds. The dividing cutter will therefore only be used for dividing the side fold and the part of the lower film web lying under the cutter. The remaining part of the lower web will thus not be divided. A secure guiding of the film web is provided hereby.

Then there is performed a joining of the upper and lower film webs used for forming the front and back sides of the bags. This is effected by use of advancing rollers. The part of the upper web, which is subsequently used for forming the bottom, is cut off from the upper web. By a double web production process, the upper film web will also be divided into a left and a right film web part.

Then folding of the bottom fold, which is contour welded, is effected. Two weldings are performed at the bottom of the bag such that subsequently an unfolding of the bottom can occur.

The bottom is unfolded by means of guide rollers and moved through an angle of about 90° over reversing rollers in order to smoothen the film.

The film web, which has been cut off from the original film web in the film storage in a previous step and is to constitute a bottom film, is moved transversely of the upper and lower film webs. Then the guiding is turned such that it is moved along the conveying direction of the film webs. By this orientation, the bottom film is laid upon the unfolded bottom.

Then is established a welding and subsequent cooling of the bottom folds. The unfolded bottom with the supplied bottom film will typically be welded by means of three welding devices transversely of the bottom fold, and subsequently cooled in a cooling unit.

A folding in of the bag bottoms is then performed. The bag bottoms are folded in by means of guide rollers and moved through an angle of 90° over a reversing roller in order thereby to establish smoothing of the film.

After this step, the formed bag webs are moved through advancing rollers that also provide web tensioning.

In the subsequent step, a longitudinal dividing into a right and a left bag web is performed. By this division is provided a welding of the edge area of the film webs in longitudinal direction such that the bottom fold welding is completed.

After this welding, an advancing action and a web tension are established again by means of advancing rollers.

Subsequently will be established a welding together of the bottom folds transversely of the conveying direction of the film webs.

Then a welding transversely of the entire film web is performed by means of welding jaws. Here, there will be a welding which does not extend from side edge to side edge.

The welding jaws will thus perform a welding such that the peripheral strip areas in which holes or star perforations are to be formed are not welded together.

In the subsequent step is established a cooling which can be effected in one or two steps transversely of the longitudinal direction of the film web.

In subsequent steps punching of holes in the peripheral strip areas and trimming of the films are performed. As the last step in the process, an advancing movement is effected, and at the same time is used a dividing cutter for establishing bag webs and trimming of peripheral strip areas.

The bag webs then appear as contiguous bag webs that can be conveyed on support rails and moved through a filling station in the way described above. The bag webs will typically be moved to a storage and not directly to a filling station.

It is noted that the above method steps for making the contiguous bag webs use method steps and techniques disclosed in the Chinese documents CN203173589 U, CN203173588 U and CN203172081 U. These documents are hereby incorporated by reference.

All of the above embodiments are described as examples, and it will be possible to design the invention in another way, if only it is ensured that a bag web is formed, including bag items with inserted side and/or bottom sections in connection with peripheral strip areas in which a series of holes or corresponding star perforations are formed.

DESCRIPTION OF THE DRAWING

The invention will now be explained in further detail with reference to the accompanying schematic drawing, wherein.

DETAILED DESCRIPTION OF EMBODIMENTS OF THE INVENTION

In the explanation of the Figures, identical or corresponding elements will be provided with the same designations in different Figures. Therefore, no explanation of all details will be given in connection with each single Figure/embodiment.

Figure 1:
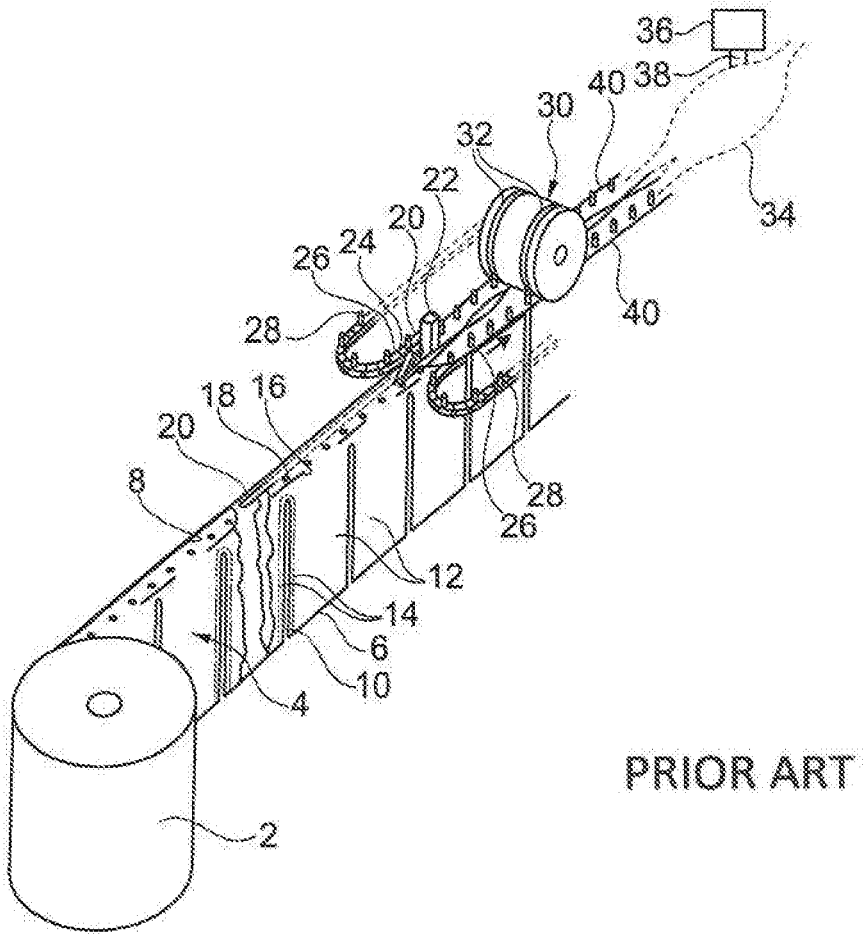
FIG. 1 is a perspective view for illustrating a technique known from EP 1 087 890 with a bag web including a single row of bag items.

FIG. 1 shows prior art and serves to illustrate a principle for designing peripheral areas at the outermost opposite bag opening edges and guide means adapted to retain and guide the peripheral areas at opposing bag opening edges.

In FIG. 1 is shown that from a supply roll 2 a film material web 4 can be unrolled, consisting of a double film folded about a bottom edge 6 and joined along the upper edge by a simple welding 8, without foldings or thickenings of any kind. Therefore, it may also be a tubular film. In the web appears a series of slits 10 that extend from the bottom edge 6 up to a point below the top edge 8 so that the web appears with mutually separate bag items 12, the side edges of which closed by weldings 14. Right over the top of the slits 10, the double web is cut by respective horizontal lines 16 extending shortly out at either side of the associated slits 10.

Between the top edge 8 and the cutting lines 16, the peripheral areas 40 of the web are penetrated by a single row of perforations 18.

This previously made web 4, which instead of being rolled up better can appear in a supply box in zigzag folded shape, is unwound by a filling unit on a support bar or rail 20 extending from a fixed support member 22 of the unit and serving as simple support for the closed top edge 8 of the web 4.

At a short distance in front of the carrier member 22, the support bar 20 has an upwardly projecting cutter member 24 which by advancing the web will continuously cut the top edge of the latter, and thereafter is arranged a continuing carrier system consisting of opposing parallel carrier chains 26 that are made with upright holding studs 28 for engaging holes 18 in respective top parts of the web that are laid out at both sides, and by a pressing roller 30 which after threading the film web in provides for drawing down the said unfolded top edge areas of the web 4 towards the firmly supported carrier chains 26 for horizontal bearing against the top sides of the latter, and thereby under pivoting down of the holes 18 in such a way that the holes 18 are pivoted down and engage over the chain studs 18. The pressing roller 30 has turned-in grooves 32 for enabling free passage of the outer end parts of the chain studs 28, and in these grooves there are embedded transversely positioned studs (not shown) which like a cogwheel can interact with the chain studs 28 for automatic synchronous driving of the pressing roller 30.

The opposing upper edge parts of the web 4 will then be securely anchored to the carrier studs 28, and the carrier chains may then be guided through a desired course for successive opening of the bag items as indicated by 34, whereby they can be filled by a filling apparatus 36 disposed above the open bag item and for closing the items after filling thereof. The filling apparatus 36 is provided with a filling unit in the form of a filling nozzle 38. It is considered unnecessary to indicate this in more detail. However, it is to be noted that the studs 28 are provided in the neutral lines of the chains such that the bag item web is not subjected to tensioning or slacking in passages with changes of direction.

The filled bags are released from the rest of the web, which is rolled up as excess, by welded closing of the bag items immediately under the top of the slits 10 and a possible subsequent cutting off.

It is to be mentioned that on the fixed carrier member 22 there is preferably provided a guide body with a double-wing ploughshare shape that actively produces or initiates the shown unfolding of the perforated web periphery areas, whereby an improved security can be achieved with regard to the important function that is the guiding of the holes down over the studs 28.

Figure 2:
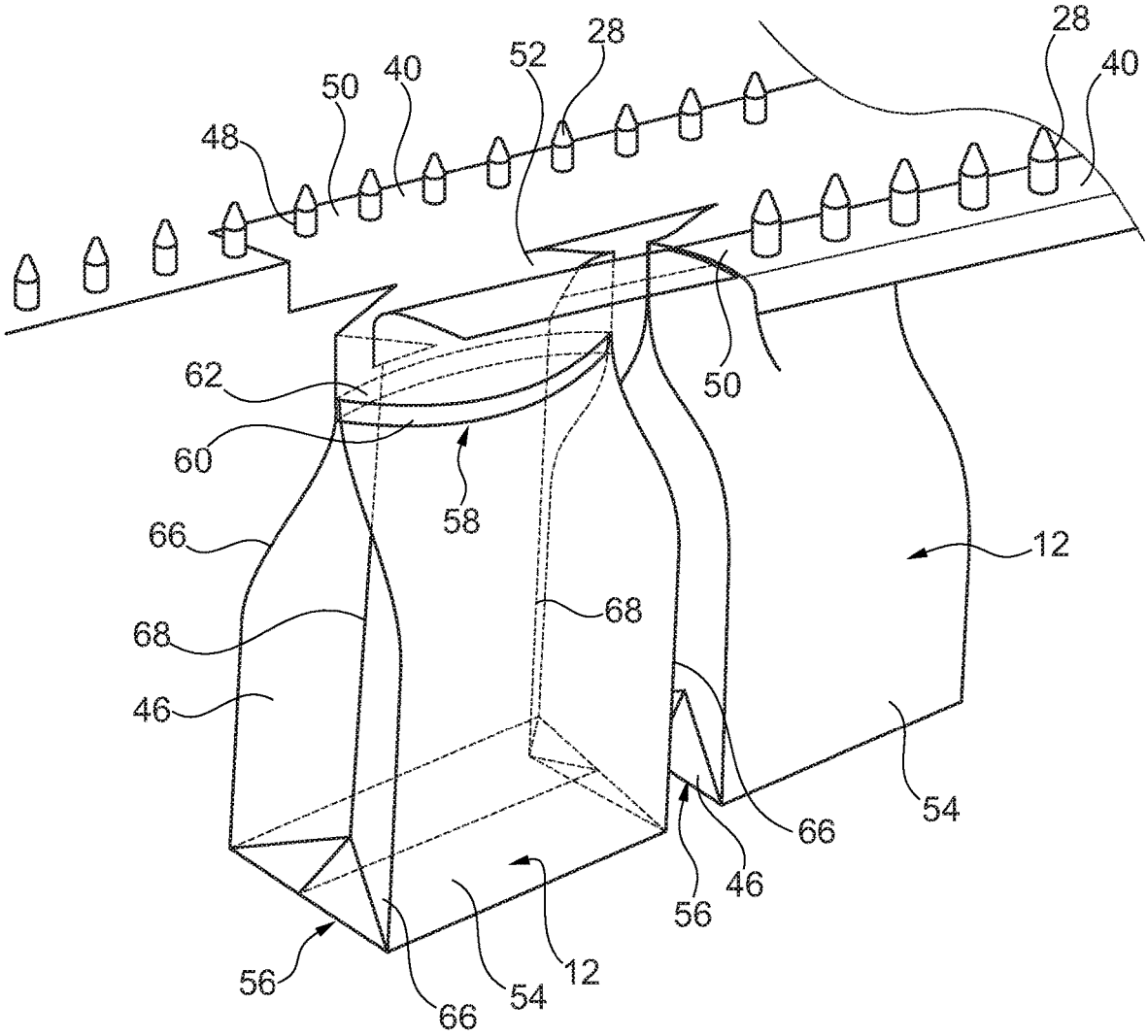
FIG. 2 is a perspective partial view of a bag web according to the invention with a series of bag items provided with a zipper, and with the bag items in partly open condition.

FIG. 2 shows a detail of the bag web according to the invention with a number of bag items 12 in a position where studs 28 of the carrier chains 26 are passed through apertures 48 in peripheral strip areas 50. The peripheral strip areas 50 are thus provided at bag opening edges 52 such that the peripheral strip areas 50 are contiguous with the bag items 12.

The bag items are formed with two opposing flat sides 54, and between these there a provided folded side sections 46. Moreover, bottom sections 56 are provided between the flat sides 54.

In the shown embodiment, a zipper is provided in that a first zipper part 60 is provided on one flat side and a second zipper part 62 is provided on the opposing flat side of the bag item. In this embodiment, the zipper 58 is shown at a position immediately under the bag opening edges such that the bag can be opened across its entire width.

Figure 3:
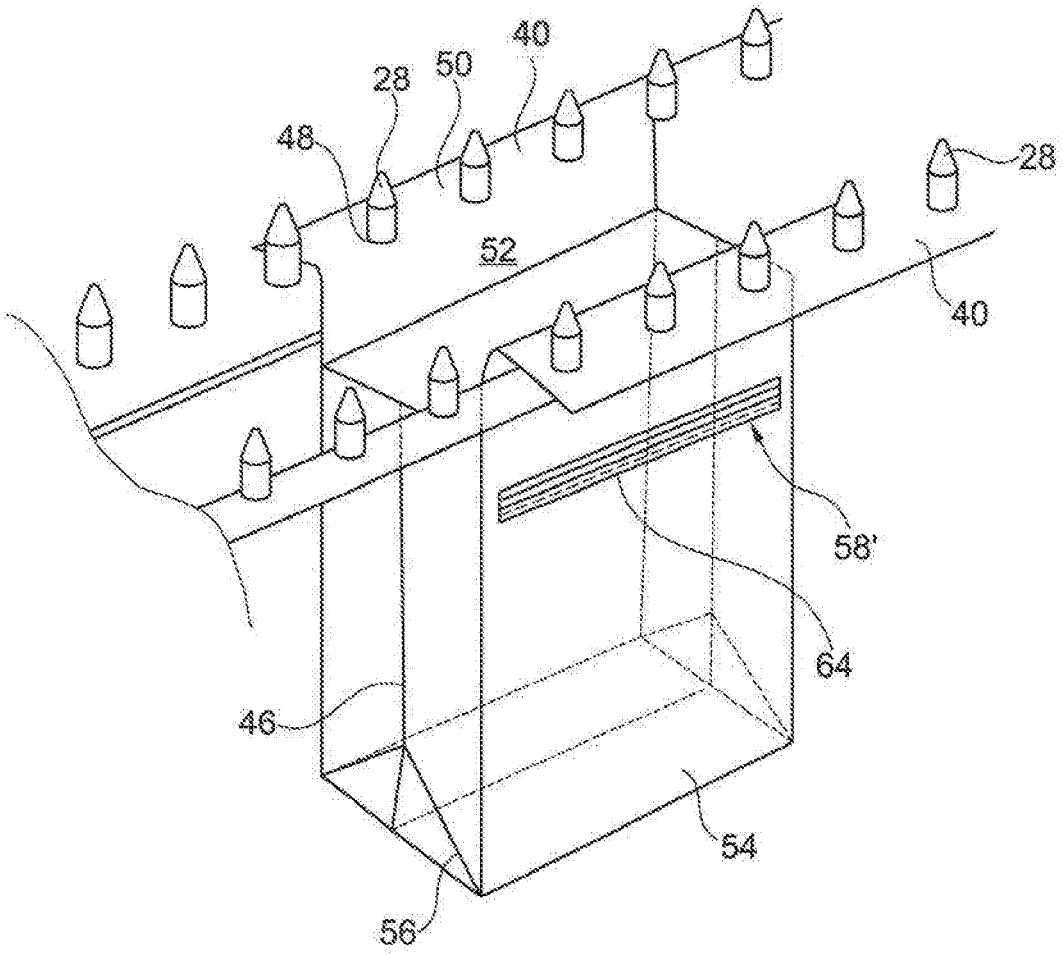
FIG. 3 is a perspective partial view of a bag web according to the invention with bag items provided with a different type of zipper, and shown in almost completely open condition.

FIG. 3 shows a detail of a bag web corresponding to the bag web shown in FIG. 2. In this bag web, however, the zipper 58' is provided in one of the flat sides 54 of the bag item 12. In immediate connection with the zipper 58' there is provided a perforation 64 defining an access opening to the bag. This access opening will thus be provided in the flat side 54.

Figure 4:
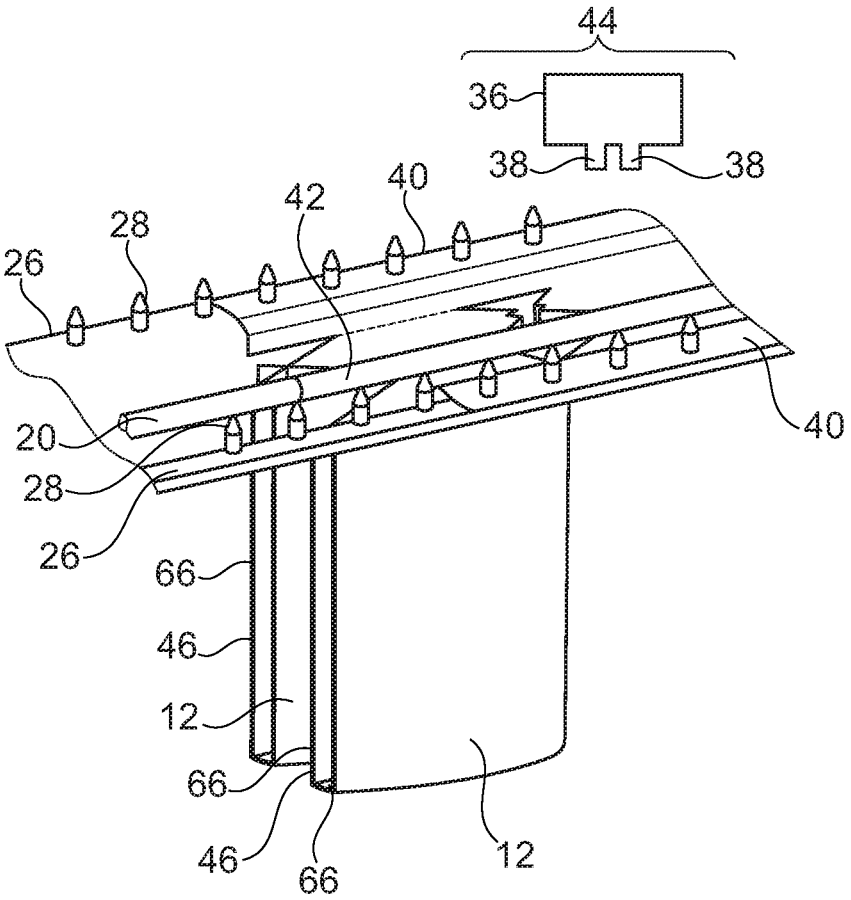
FIG. 4 is a perspective partial view of a bag web with two rows of juxtaposed bag items in partly open condition in a bag web according to the invention.

FIG. 4 shows an apparatus according to the invention, wherein a bag web with two juxtaposed bag items 12 is applied. At the outermost peripheral areas 40, the bag items 12 are penetrated by perforations 18 that enable fastening to the retainer studs 28. At the bag sides which are disposed close to each other, the peripheral areas of the bag sides are formed of a central support region 42 extending longitudinally of the bag web. The central support region 42 is placed on the support rail 20. According to the invention, the support rail 20 is extended compared with the length shown in FIG. 1. The support rail 20 will therefore extend along the conveyor path through a filling station 44 where the filling apparatus 36 is provided. The filling apparatus 36 has two juxtaposed filling nozzles 38 for simultaneous filling of the two juxtaposed bag items 12.

In a situation before the partial view shown in FIG. 4, the film web can be handled by a system as described with reference to FIG. 1. In a situation after the partial view shown in FIG. 4, the bag webs can be closed and cut off in a way analogous to that explained in connection with the bag web shown in FIG. 1.

Figure 5:
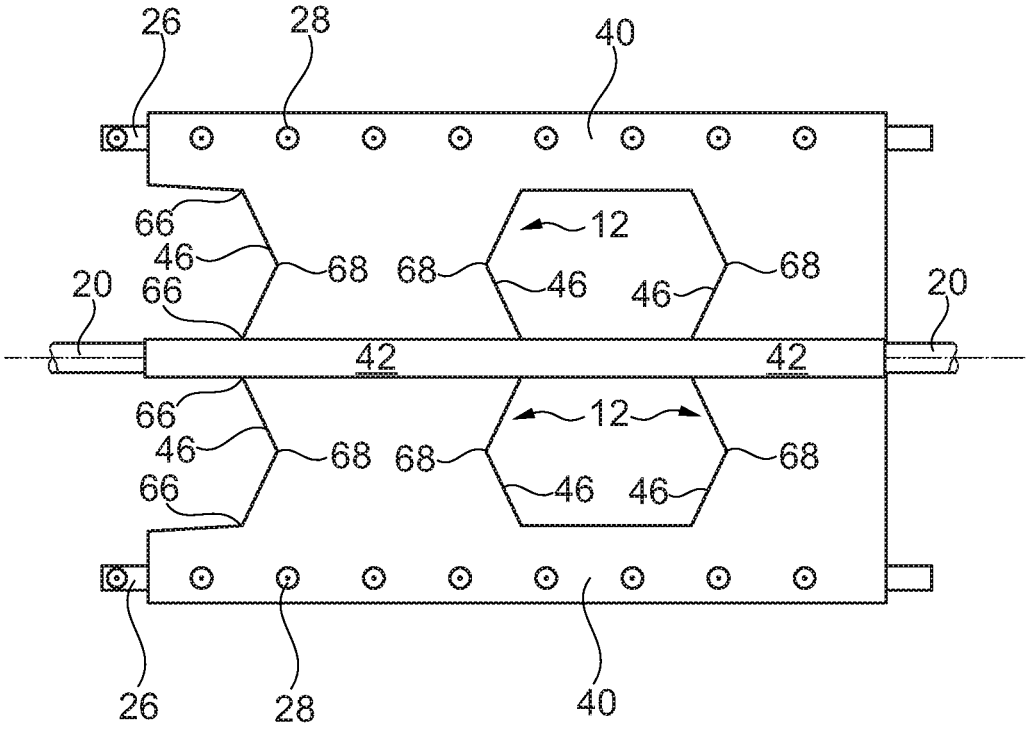
FIG. 5 is a partial view from above of the bag web shown in FIG. 2, but with the bag items in fully open condition.

FIG. 5 shows a view corresponding to the view shown in FIG. 4, but seen from above. It is seen here how the bag items 12 are moved farther away from each other such that they now are completely open. In this situation, the bag items 12 will be located at the filling station 44 (not depicted in FIG. 5 for the sake of clarity).

The bag items 12 have side edges that are formed by means of folded side sections 46. This is true for the bag items shown in all of FIGS. 2-5. The side sections 46 are fastened to the flat sides 54 via weldings 66. As seen on FIGS. 2-5, the side sections 46 are provided with a folding along a line 68.

The bottom sections 56 can be provided as separate film sections or provided by bending the edge areas of one of the film webs used for making the flat sides 54 in the bag items. In the following and with reference to FIGS. 6-16, details of making the bag web used by the method according to the invention will be described.

Figure 6:
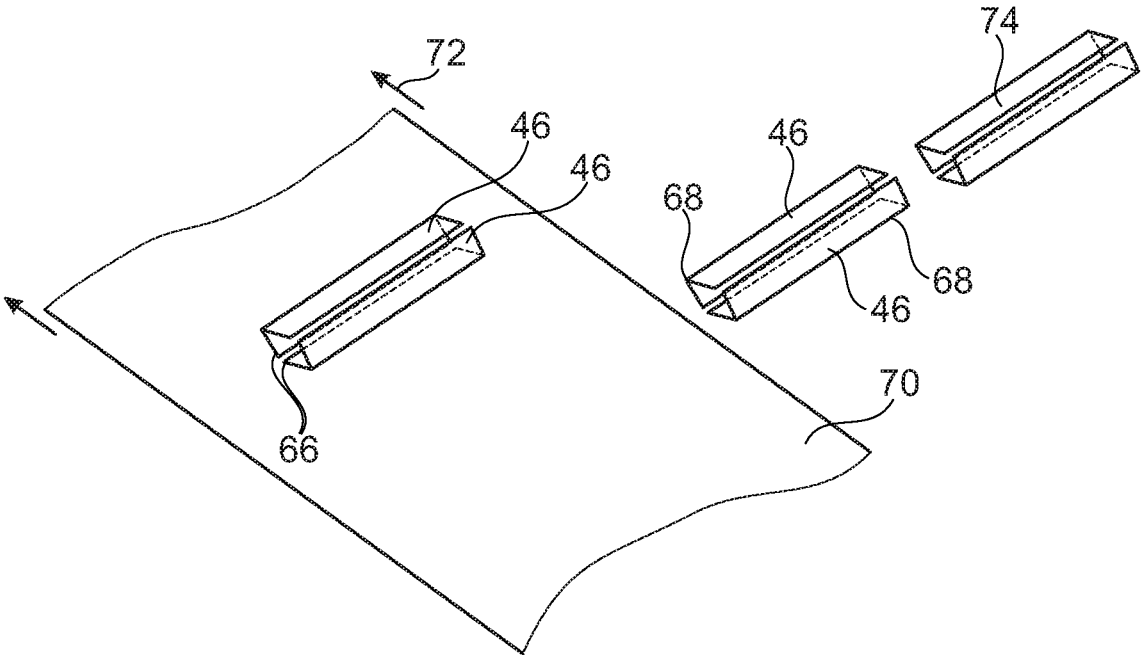
FIGS. 6-16 show partial views illustrating a method according to the invention.

In FIG. 6 is seen a first film web 70 that is conveyed in direction of the arrows 72. An insertion direction 74 at which side sections 46 are provided on the film web 70 is at right angles to the conveying direction 72. The side sections 46 are folded about the edge 68. The side sections 46 are fastened on the film web 70 by means of weldings 66. The side sections 46 are inserted in pairs on the film web 70, as shown.

Figure 7:
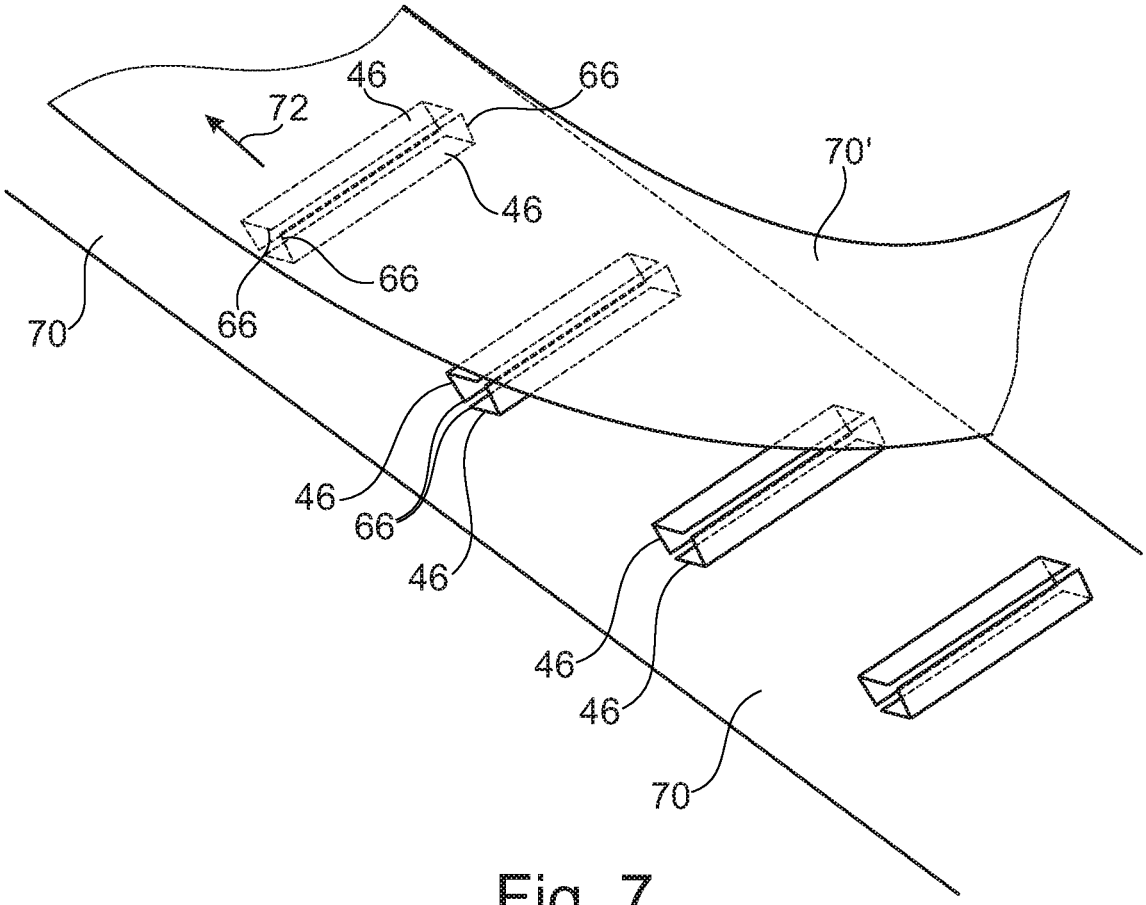
Figure 8:
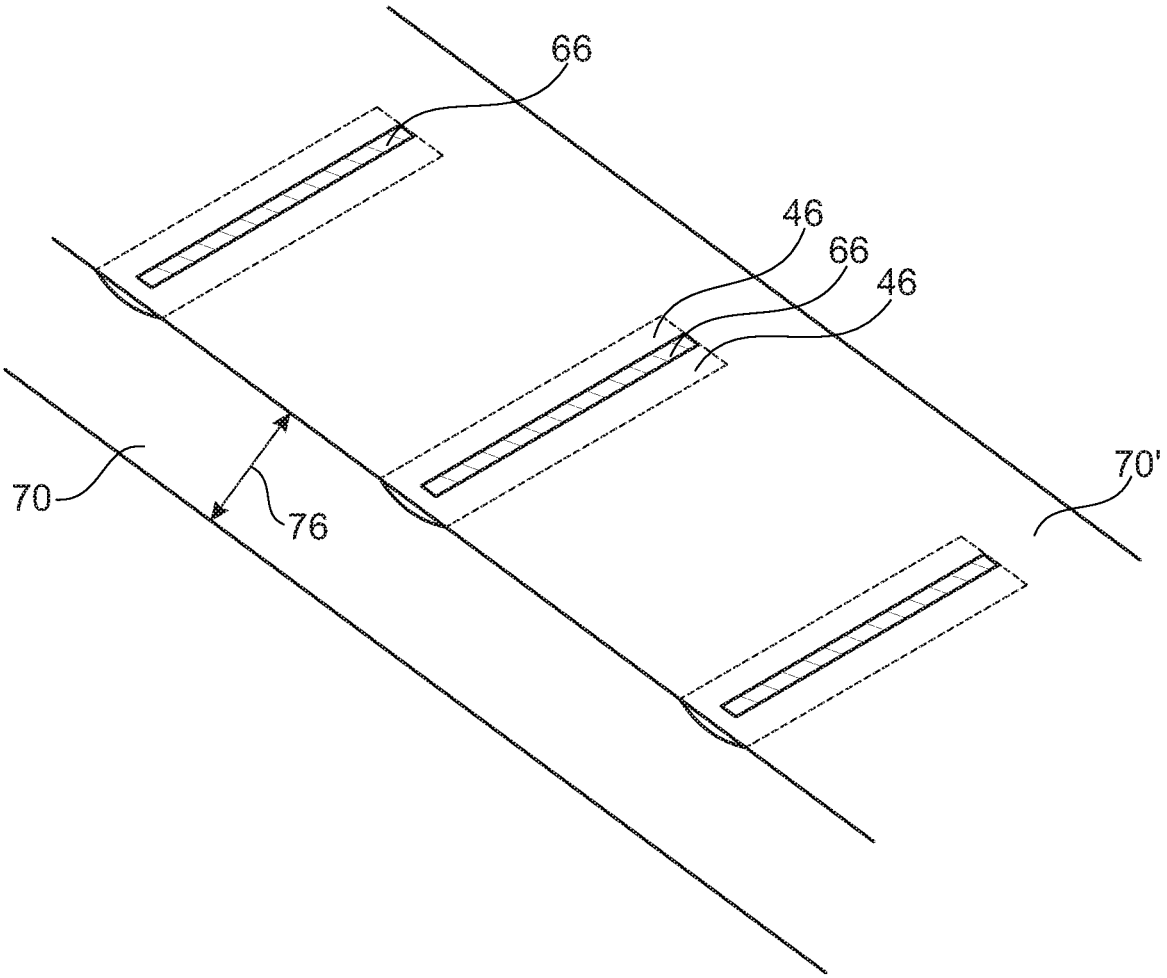
Figure 9:
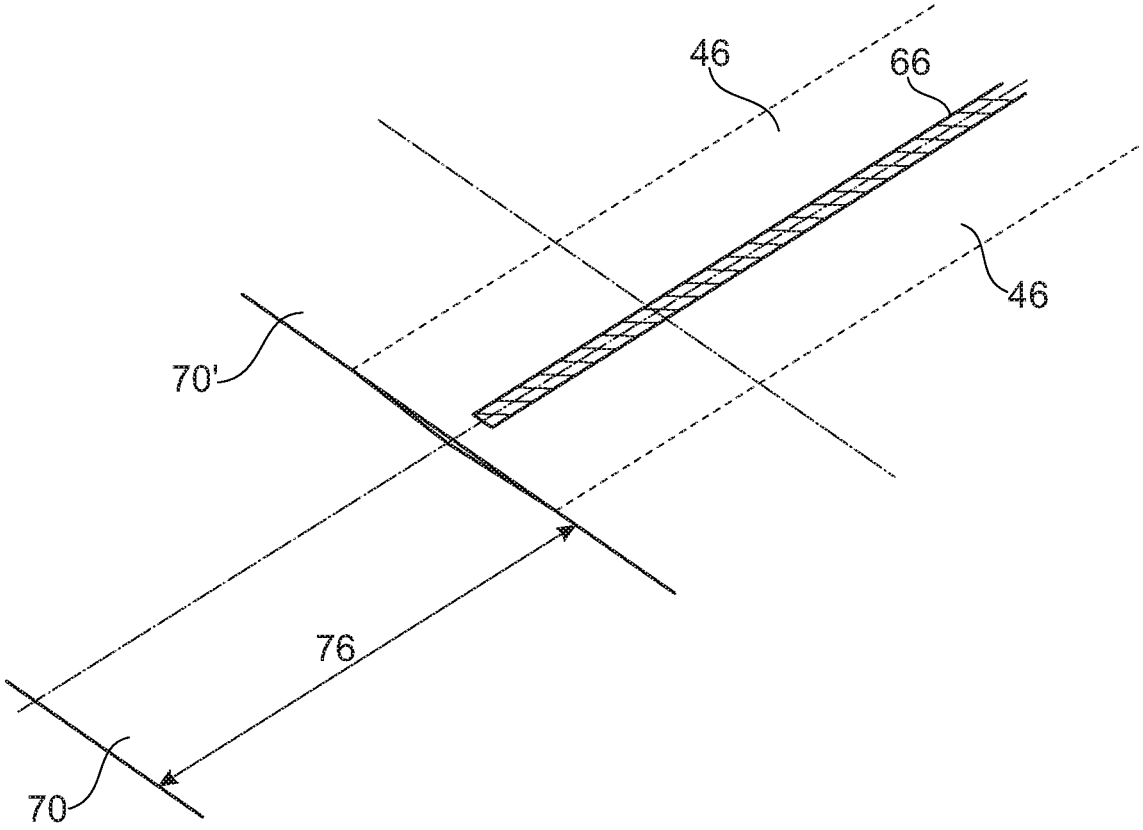

FIG. 7 illustrates how a series of side edges are fastened by welding to the film web 70, after which a further film web 70' is moved down towards the film web 70 with the side sections at a position between the to film webs 70, 70'. The side sections are also welded by weldings 66 to the additional film web 70'. FIG. 8 shows more clearly how the weldings 66 extend along part of the length of the side sections 46.

As it appears from FIGS. 7 and 8, the first film web 70 has a greater width than the additional film web 70'. There is thus a peripheral area 76 of the film 70 that extends beyond the outer edge of the film web 70'. This is particularly clearly seen on FIG. 9.

Figure 10:
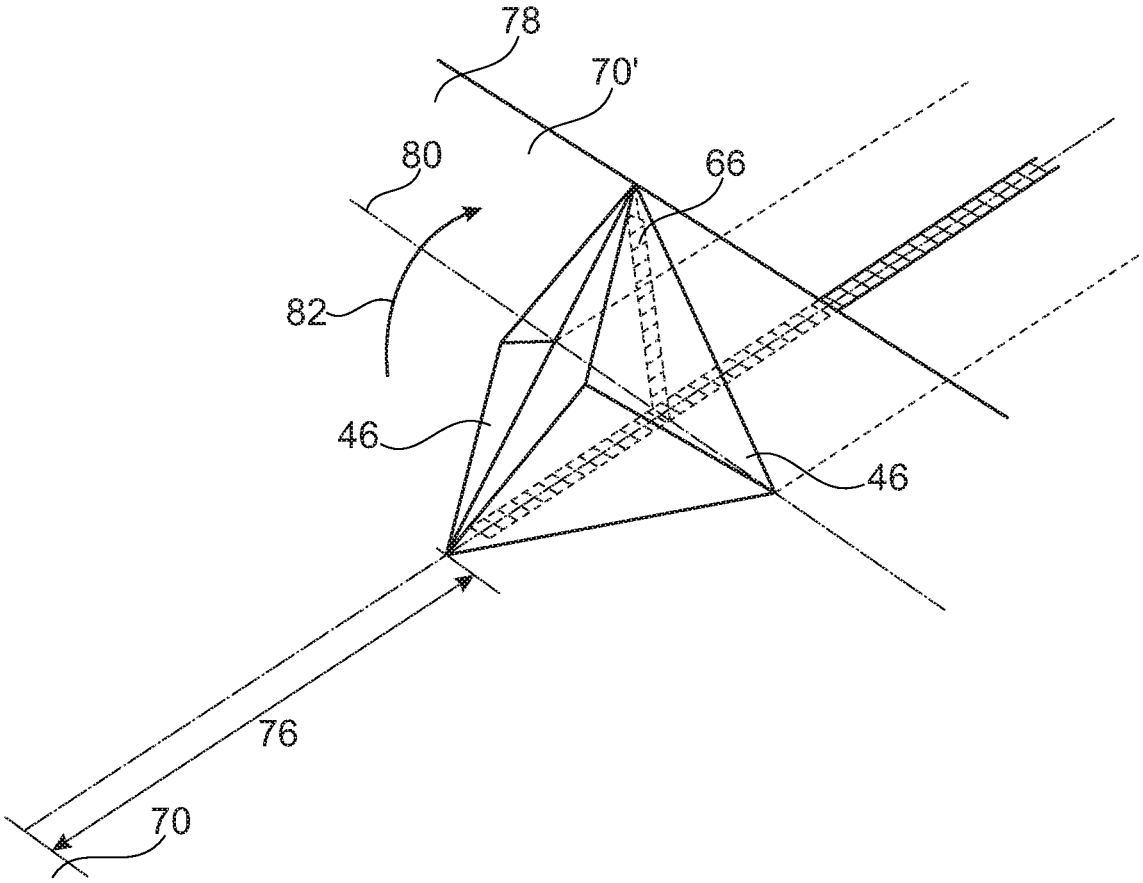

The film webs 70, 70', shown i.a. in FIGS. 7 and 8, are usually made slightly wider than illustrated at the side where the bud of the bag item is to the formed. Such an extra width at the peripheral area of the film webs is important in practice in order to have a sufficient amount of film to grip in at the folding of the film webs. FIG. 10 shows a beginning folding for formation of a stand bottom. A peripheral area 78 of the additional film web 70' is folded about a folding line 80' upwards according to arrow 82. As seen, the folded side sections 46 will be opened hereby.

Figure 11:
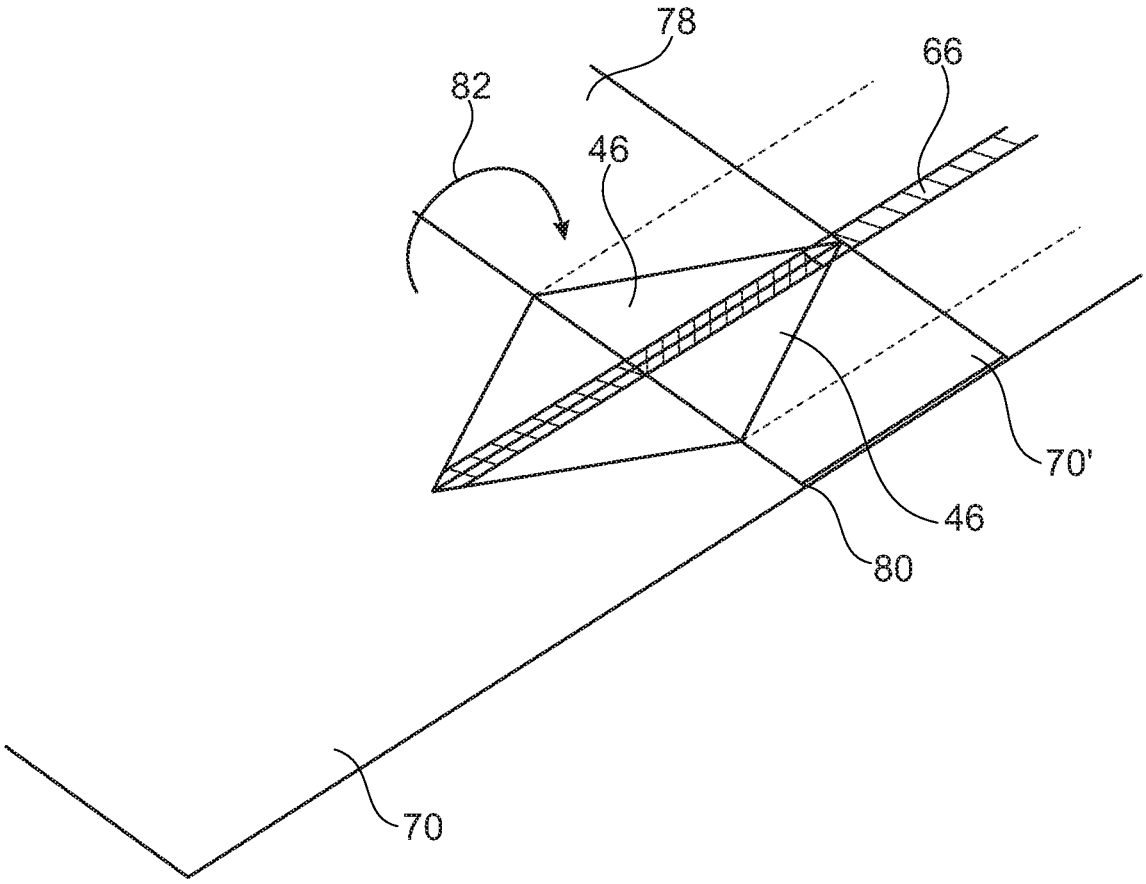

FIG. 11 shows a subsequent step where the film web 70' is folded 180° back such that the peripheral area 78 is disposed upon the remaining part of the film web 70'. This means that the folded side section 46 is now completely open and appears flat.

Figure 12:
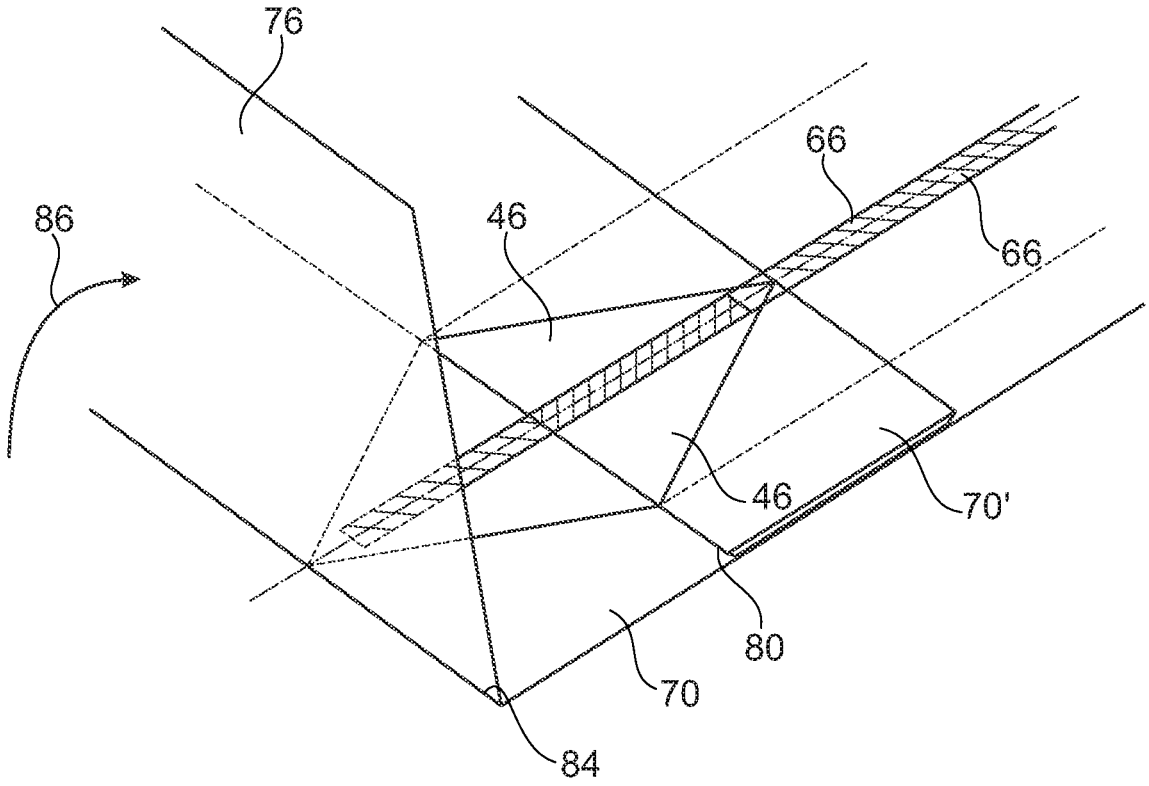

In FIG. 12 is seen a following step where the peripheral area 76 of the film element 70 is folded about the folding line 84 by folding according to arrow 86. The folding line 84 is defined as the outermost point of the side sections 46. The edge area 76 is folded in over the side sections 46 and the further film web 70'.

Figure 13:
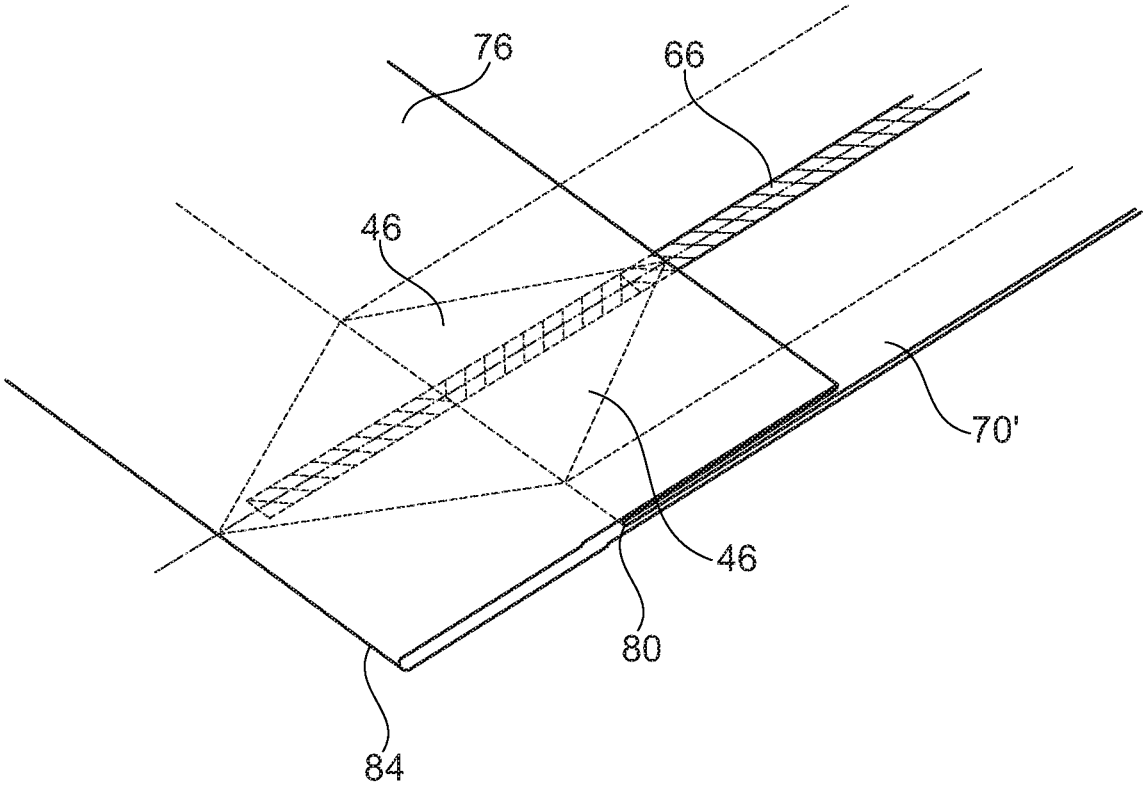

FIG. 13 shows the fully folded position where the edge area 76 is folded 180° in over the other film elements. It appears that the edge area 76 covers the two unfolded and open side sections 46.

Figure 14:
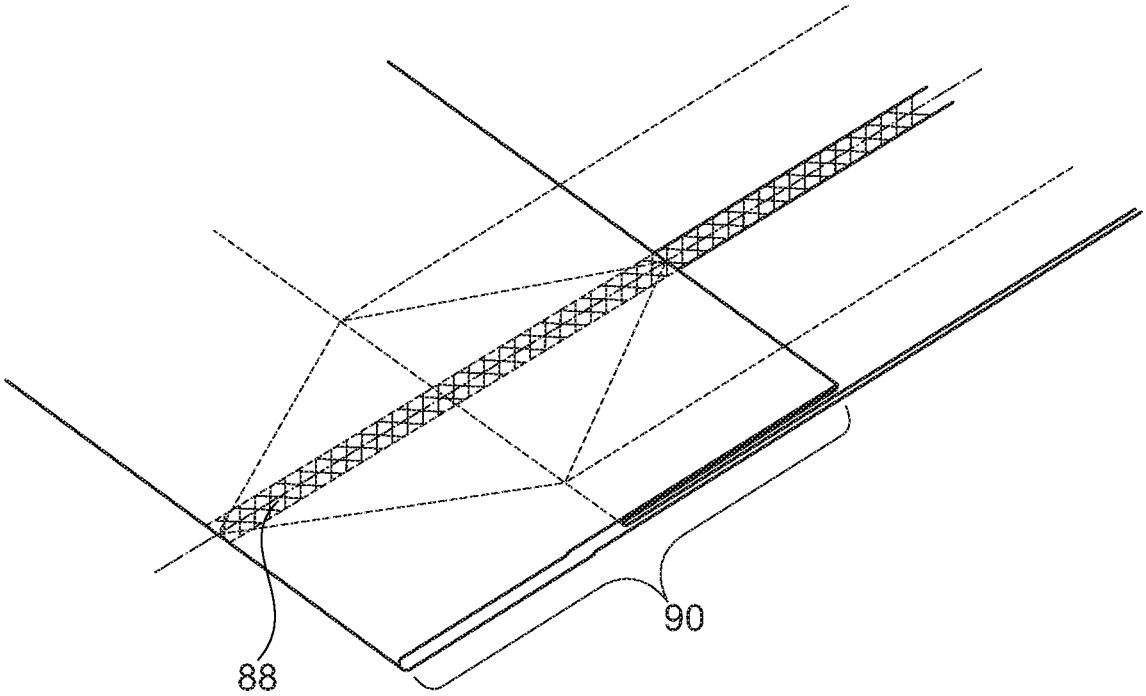

FIG. 14 illustrates a subsequent step where a transverse welding 88 is effected throughout the entire length of the side sections. The side sections 46 are located in the part which subsequently will constitute part of the stand bottom in a bag.

Figure 15:
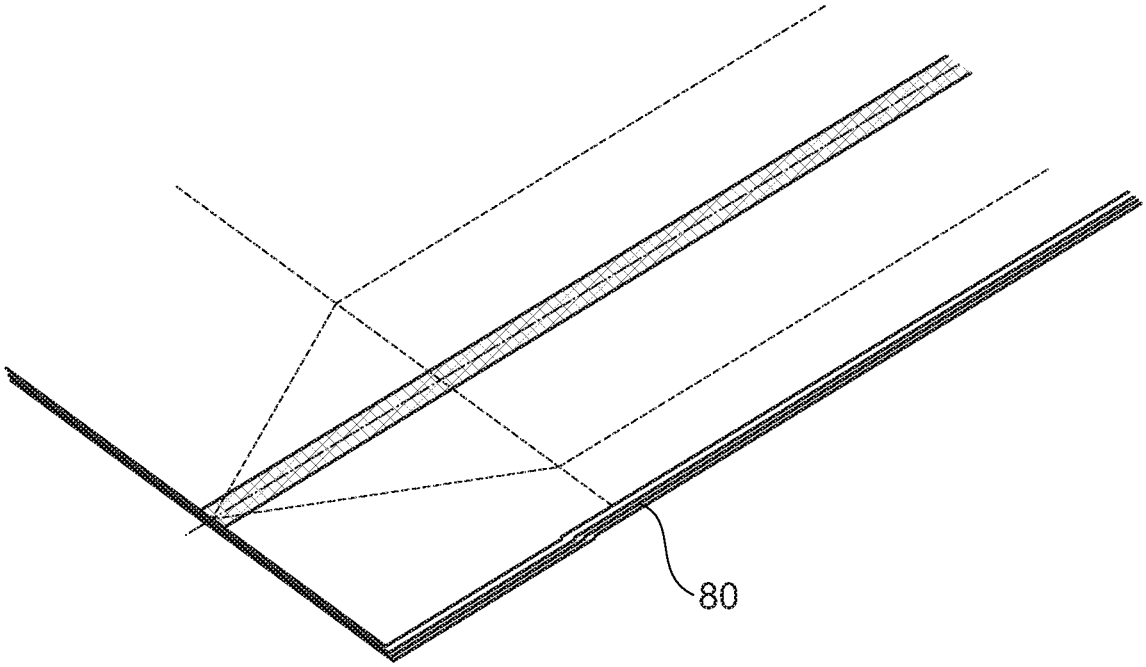

FIG. 15 shows that the film web 70 is now welded together with the side sections 46 and the additional film web 70', and then folded 180° back over the line 80.

Figure 16:
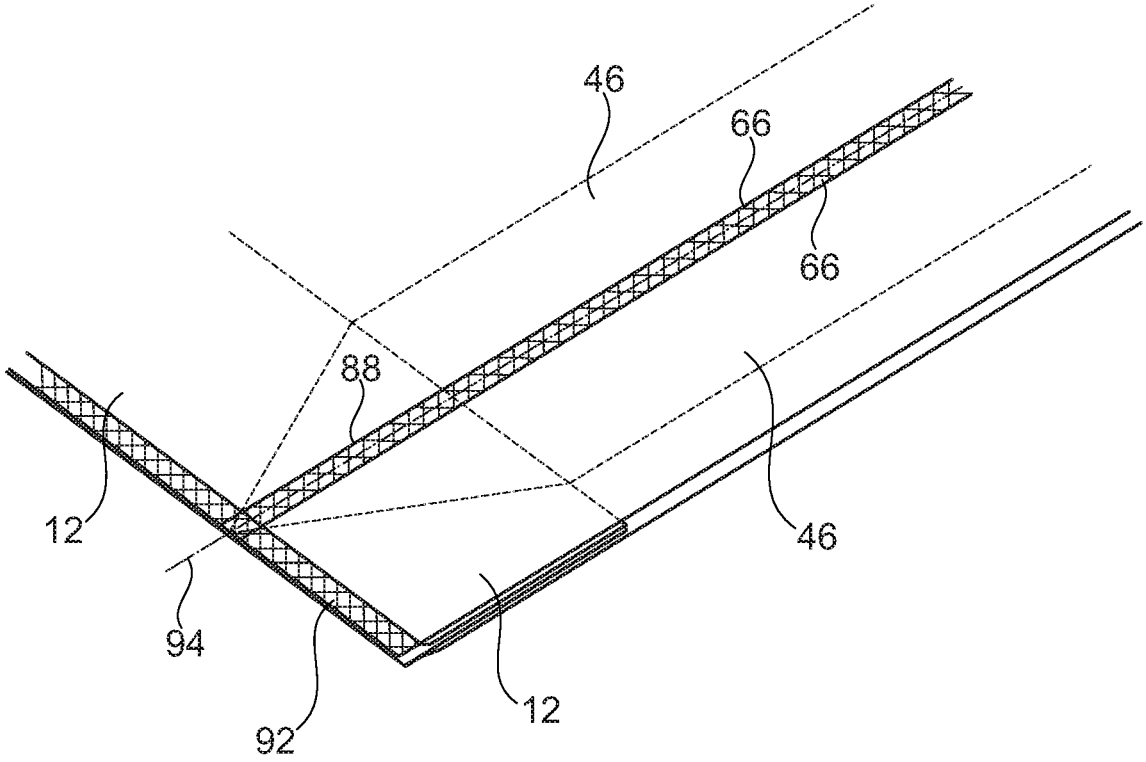

FIG. 16 illustrates a final detail where the film webs 70, 70' are provided with longitudinal weldings 92 that will form edges in the stand bottom of a finished bag.

After the step shown in FIG. 16 it is preferred that the bottom film is trimmed. Hereby the extra width of the film webs 70, 70' is removed mentioned in connection with FIGS. 7 and 8, and which have been used for getting hold when folding the film webs.

By the above described steps, now there will be formed a bag web with contiguous bag items 12. The bag items 12 can be separated with slits along the line 94 such that they appear in a form corresponding to the one shown in FIG. 1 where the bag items 12 at their upper edge (not shown in FIGS. 6-16) are connected with the peripheral strip areas 50.

The bag web can be stored on a roll or by zigzag folding in boxes.

In FIGS. 6-16 is not shown how a zipper is introduced in the process. However, a zipper 58 as illustrated in FIG. 2 will be inserted on the film webs immediately before the joining of the film webs illustrated in FIG. 7. A zipper 58', shown on FIG. 3, will be inserted together with the side flat sections 46 in the method step illustrated in FIG. 6.

In connection with FIGS. 6-16 is illustrated a specific embodiment of a method for forming the bag items. By this embodiment, the edge area 76 of the film web 70 will be used for formation of the bottom of the bag item.

The bottom may alternatively be formed of film sections that are inserted separately.

In the making of the film web it is thus possible to use the production methods explained in EP 1 250 999. However, it is to be ensured that by the technique disclosed in EP 1 250 999 there is used film webs which at their upper side have a peripheral area which can be used for forming the peripheral strip areas with the star-shaped perforations.

Figure 17:
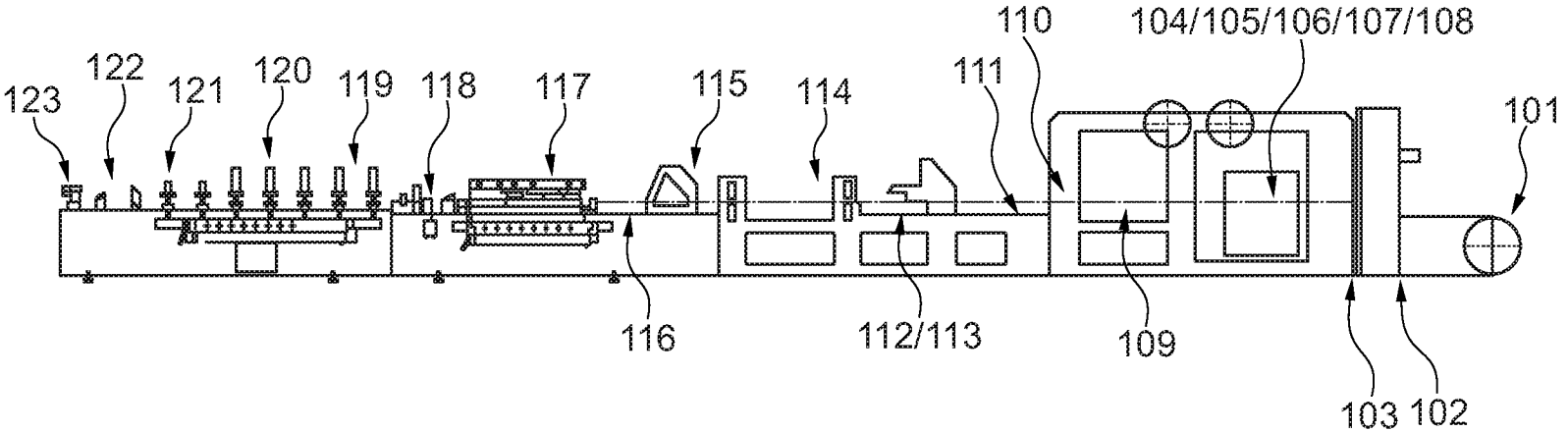
FIGS. 17-18 show a side view and a perspective view illustrating a further method according to the invention.
Figure 18:
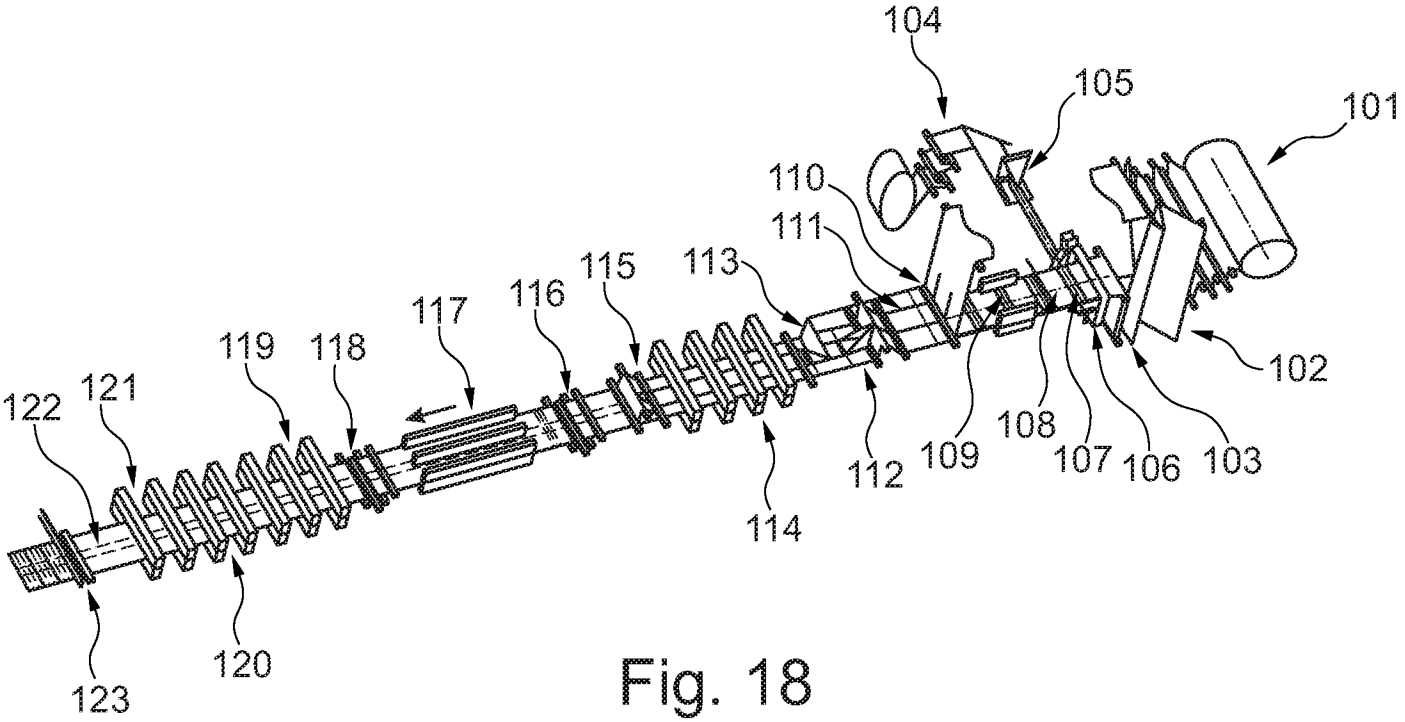

In FIGS. 17 and 18 is illustrated an alternative method for making the bag webs. It is noted that by this model are not specifically shown method steps where the formed bag webs are top welded to form a guide channel, and where the formed bag webs are moved to a storage as a continuous bag web such that the bag webs subsequently are inserted into a filling machine from the storage. The continuous film web may alternatively be moved directly into a filling machine.

In FIGS. 17 and 18 appears a production of bag webs in a process from the right side of the drawing towards the left side of the drawing. Explanation is made with simultaneous reference to both Figures.

Unwinding a film from roll 101 is performed. This film web is called mother film. The mother film is used for front side and back side and bottom. In the shown embodiment, a dividing is made for producing two bag webs.

A web tensioning is established in a buffer unit 102 as well as a buffer is established. In this buffer unit is also established an edge guidance and a vertical folding. At the same time, the mother film is divided into an upper and a lower film web. Part of the upper film web is subsequently used for forming the bottom of the bag. The lower film web will subsequently be applied separate side folds.

The conveying of the film is changed in a converter 103 from continuous to intermittent conveying. The material for forming side folds comes from a side fold dewinder 104 from where unwinding of the film subsequently moved transversely of the lower web is effected. A folding unit 105 is used for folding the side fold film for formation of a tube. At the same time is also here established an edge guiding of the film.

The welding unit 106 is used for spot welding of the formed tubular profile before this tubular profile is inserted transversely of the lower web. A cutter (not shown) will here be located for shortening of the side fold film to the desired length.

A film transfer unit 107 transfers the side fold film to the lower film web in a two-step transfer. In the first transfer step, the side fold film section is transferred transversely of the film web between two toothed belts (not shown). The side fold section is then transferred to the lower web in its conveying direction.

A spot welder 108 provides spot welding of the side fold film on the lower web. A dividing cutter is used for dividing the side fold film. A longitudinal dividing is thus performed for folding up two bottom folds.

A dividing cutter 109 only divides the side fold and the lower film web lying under the dividing cutter 109. The rest of the lower web is not divided. In this way it will be possible to guide the film web.

A guiding/joining unit 110 is used for moving the upper and lower film webs together. In this unit, advancing rollers are also provided. By this process, a cutter (not shown) will be used to cut off the part of the upper web used for the formation of the bottom.

In this unit, the upper film web is also divided into a left and a right web for the formation of two bag webs. If it is desired to make a single bag web, the upper web will not be divided in this step.

111 is a contour welder used for folding up the bottom folds. Weldings are performed herein at the bottom of the bag such that the bottom can be unfolded subsequently.

Guide rollers 112 are used for unfolding the bottoms. The bottoms will hereby be moved through an angle of 90° over reversing rollers such that a smoothing of the film is effected.

In a transfer unit 113, the cut bottom film from the mother film will be moved transversely of the upper and lower film web and then along these film webs. Then the cut film web is laid upon the unfolded bottom.

The unit 114 is a combined bottom fold welder and cooling unit. Herein the unfolded bottom with associated bottom film is now welded transversely of the bottom fold by means of three welders. It is then cooled in a cooling unit.

A guide unit 115 is used for inserting the bag bottoms. In this guide unit, the bag bottoms are folded in by means of guide rollers and moved through an angle of 90° over a reversing roller such as to provide smoothing of the film.

116 are advancing rollers used for advancing and establishing web tension.

In a welding unit 117 is performed a welding in longitudinal direction of the film web in the division left and right bag web. The welding of the bottom fold is hereby completed.

An advancing unit 118 is provided with advancing rollers for advancing the film webs and for providing web tension in the latter at the same time.

A welding unit 119 includes welding units that provide welding of the bottom folds transversely of the film web.

Three welding jaws are provided in the welding unit 120, providing welding transversely of the film web. Even if not appearing on the Figure, the welding jaws used will be arranged such that welding does not occur in the entire width. There will thus be peripheral strip areas without welding, and which are subsequently to be used for guiding the bag webs. In these peripheral strip areas there will subsequently be established perforations, as well as a top welding will occur as well, such that the bag webs afterwards appear with a closed edge area provided with perforations. This closed edge area is used for guide connection with guide means.

A cooling unit 121 provides cooling transversely of the film web.

In a processing unit 122 there is provided various tools (not shown specifically) which in a known way provide punching of holes and trimming of the film webs.

In an advancing unit 123 there are provided advancing rollers and a dividing cutter that provides a dividing such that two bag webs with contiguous bag items appear.

This continuous bag web is subsequently moved to a storage, which either includes rolling up or placing in boxes.

The invention claimed is:

1. A method for packing a product, articles, or loose material in film bags, using a bag web, the method including steps wherein:

the bag web is provided from one common mother film and a separation is performed on the one common mother film for establishing two film webs to form front and back sides of the bags, wherein one of the two films webs is wider than the second one of the two film webs, wherein the two film webs that form the front and back sides of the bags are provided along their opening edges with peripheral strip areas, in which a series of holes or corresponding star perforations are formed;

converting conveying of the two film webs from continuous to intermittent conveying, cutting off a part of one of the two film webs to form a cut bottom film web for formation of respective bottoms of the bags, moving the cut bottom film web transversely of the two film webs that form the front and back sides of the bags and then along the two film webs, moving a side fold film transversely of the two film webs, cutting the side fold film to a desired length for forming sides of the bags, superposing the two film webs and placing between the two film webs the cut bottom film web and the side fold film, the two film webs, the cut bottom film web, and the side fold film are welded together for forming the bag web, which is a contiguous web of bag items, conveying on a support rail, the bag web is brought to engage guide means that ensure retention of the bag web along a conveyor path through a filling station;

along the opening edges, the bag web is brought in guide connection with the guide means, wherein the guide means are adapted to interact with the series of holes or corresponding star perforations, thereby retaining and guiding the peripheral strip areas of the bag opening edges along the conveyor path through the filling station;

wherein, when the bag openings are guided through the filling station via the series of holes or corresponding start perforations, the guide means force the opposing bag opening edges apart for successive opening of the bags, and the bags are kept open for receiving filling material;

joining the bag opening edges again after filling the bags for closing of the bags;

closing the bags after passing through the filling station;

separating the bags from the bag web.

2. The method according to claim 1, wherein a zipper is provided on the film web forming the front or back side of the bag, the zipper including interacting zipper parts, and that in connection with the zipper and in parallel therewith a weakening line or perforation is formed that is easily torn up for establishing an access opening to the interior of a finished bag, the access opening capable of being opened and closed by means of the zipper.

3. The method according to claim 1, wherein interacting zipper parts of a zipper are placed opposite each other on the two film webs forming the opposing front and back sides of the film web of the bag, and that these interacting zipper parts are disposed in parallel with the opening edges in immediate vicinity thereof for establishing an access opening to the interior of a finished bag, the access opening capable of being opened and closed by means of the zipper.

4. The method according to claim 1, wherein longitudinal weldings forming a stand bottom edge in a finished bag are formed in the peripheral areas at the bottom side edges of the two film webs, the bottom side edges provided at the opposite side of the film webs in relation to the opening edges.

5. The method according to claim 1, wherein the bag web is provided with a central support region extending longitudinally of the bag web, the central support region connecting the bag items that are disposed side by side transversely of the web, that the central support region is conveyed on the support rail along the conveyor path through the filling station, and the peripheral areas at the outermost opposite bag opening edges of the two juxtaposed bag items are brought in guiding connection with the guide means.

6. The method according to claim 1, wherein the bag web is provided from the one common mother film, and a separation is performed for establishing the two film webs, that are to form the front and back sides of the bags.

7. The method according to claim 6, wherein the one common mother film is used for making one or two bag webs.

* * * * *